US007362964B2

(12) United States Patent
Wang

(10) Patent No.: US 7,362,964 B2
(45) Date of Patent: Apr. 22, 2008

(54) HUMIDIFIER WITH ULTRAVIOLET LAMP

(76) Inventor: Chi-Hsiang Wang, 12F-6, No. 16 Jian Ba Rd., Chung Ho, Taipei Hsieng (TW) 235

( * ) Notice: Subject to any disclaimer, the term of this patent is extended or adjusted under 35 U.S.C. 154(b) by 67 days.

(21) Appl. No.: 11/400,010

(22) Filed: Apr. 7, 2006

(65) Prior Publication Data

US 2007/0237500 A1 Oct. 11, 2007

(51) Int. Cl.
*F17C 7/04* (2006.01)
*F24F 3/14* (2006.01)

(52) U.S. Cl. ..... 392/405; 392/390; 392/391; 392/392; 392/401; 392/402; 392/403; 392/406; 261/27; 261/28; 261/34.1; 261/66; 261/73; 261/81; 261/84; 261/104; 261/107; 261/142

(58) Field of Classification Search ..... 392/405, 392/390, 391, 393, 401–406; 261/27–8, 261/34.1, 66, 73, 81, 84, 104, 107, 142
See application file for complete search history.

(56) References Cited

U.S. PATENT DOCUMENTS 6,845,971 B2 * 1/2005 Bachert ..... 261/37

* cited by examiner

*Primary Examiner*—Shawntina Fuqua
(74) *Attorney, Agent, or Firm*—Law Offices of K. W. Wang; Karry W. Wang, Esq.

(57) ABSTRACT

A humidifier that includes two water reservoir compartments connected via an opening large enough to allow exchange of water between the two compartments, and an ultraviolet lamp that irradiates on the water in the smaller of the two compartments downstream of the larger compartment.

20 Claims, 4 Drawing Sheets

HUMIDIFIER WITH ULTRAVIOLET LAMP

REFERENCE TO RELATED APPLICATIONS

This application claims priority of U.S. Provisional Application Ser. No. 60/593,373, filed Jan. 7, 2005, and U.S. patent application Ser. No. 29/226,080, filed Mar. 24, 2005, the entire contents of both of which are incorporated herein by reference as though fully and completely set forth herein.

FIELD OF THE INVENTION

The present invention relates generally to devices that add humidity to an air flow and, more particularly, to an air humidifier using ultraviolet irradiation to reduce or eliminate minerals in the humidifying water and mineral buildup in the water reservoir.

BACKGROUND OF THE INVENTION

It is well known that ultraviolet (UV) irradiation may be used to reduce or eliminate the various minerals, microorganisms, and other contaminants in water. However, all of the current humidifiers that utilize a UV lamp only sterilize the humidifying water as the water exits from the water reservoir and flows toward the heating or vaporizing unit. The flaw in these humidifiers is that the water inside the reservoir is never irradiated. Over time, therefore, mineral deposits inside the reservoir would either clog up the aperture that allows outflow of the water, cause corrosion to various parts in the humidifier or, at the very least, render the walls and bottom of the reservoir covered with unsightly mineral buildup.

SUMMARY OF THE INVENTION

The subject invention discloses an air humidifier that reduces the mineral, microorganism and other contaminant content in the water used in the air humidifier. More specifically, an air humidifier in accordance with the present invention uses an ultraviolet light source to sanitize not only the water flowing out of the water reservoir, but also the water inside the reservoir.

In the preferred embodiment, an air humidifier includes a water reservoir having two compartments, and an ultraviolet (UV) lamp. The two compartments are physically connected via an opening large enough to allow exchange of water between the two compartments. The UV lamp is used to irradiate on the water in the smaller of the two compartments, which compartment is also downstream of the larger compartment. Although the UV lamp only irradiates on the water in the smaller compartment, the water in the larger compartment is also sanitized to a somewhat lesser degree because of the water exchange between the two compartments. The water exiting from the smaller compartment is then used to humidify ambient air.

BRIEF DESCRIPTION OF THE DRAWINGS

The present invention will be better understood from the following description of one embodiment in accordance with the present invention with reference to the accompanying drawings, in which like numerals reference like elements, and wherein.

DESCRIPTION OF THE INVENTION

Figure 1:
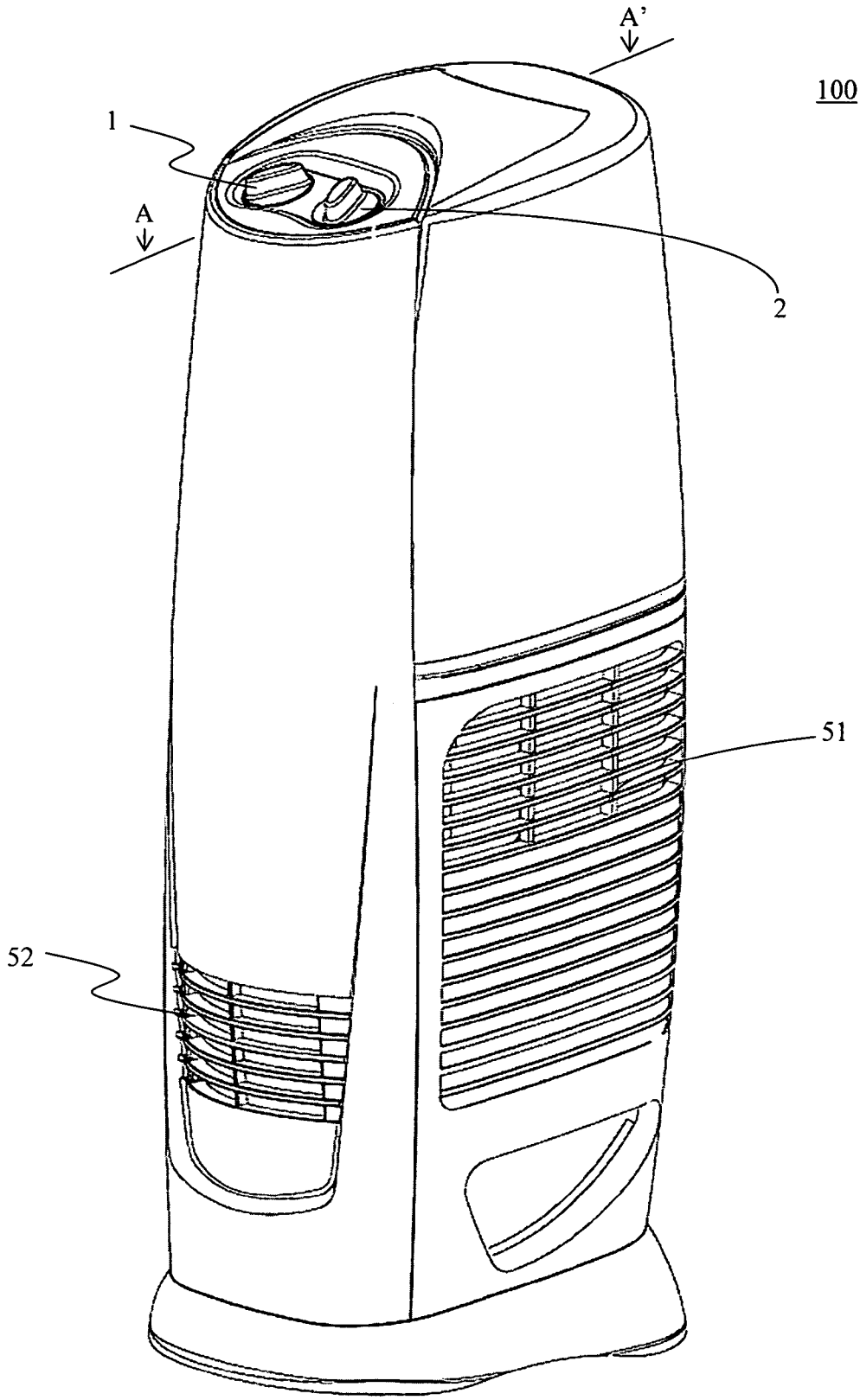
FIG. 1 is a front perspective view of a humidifier in accordance with the present invention.
Figure 2:
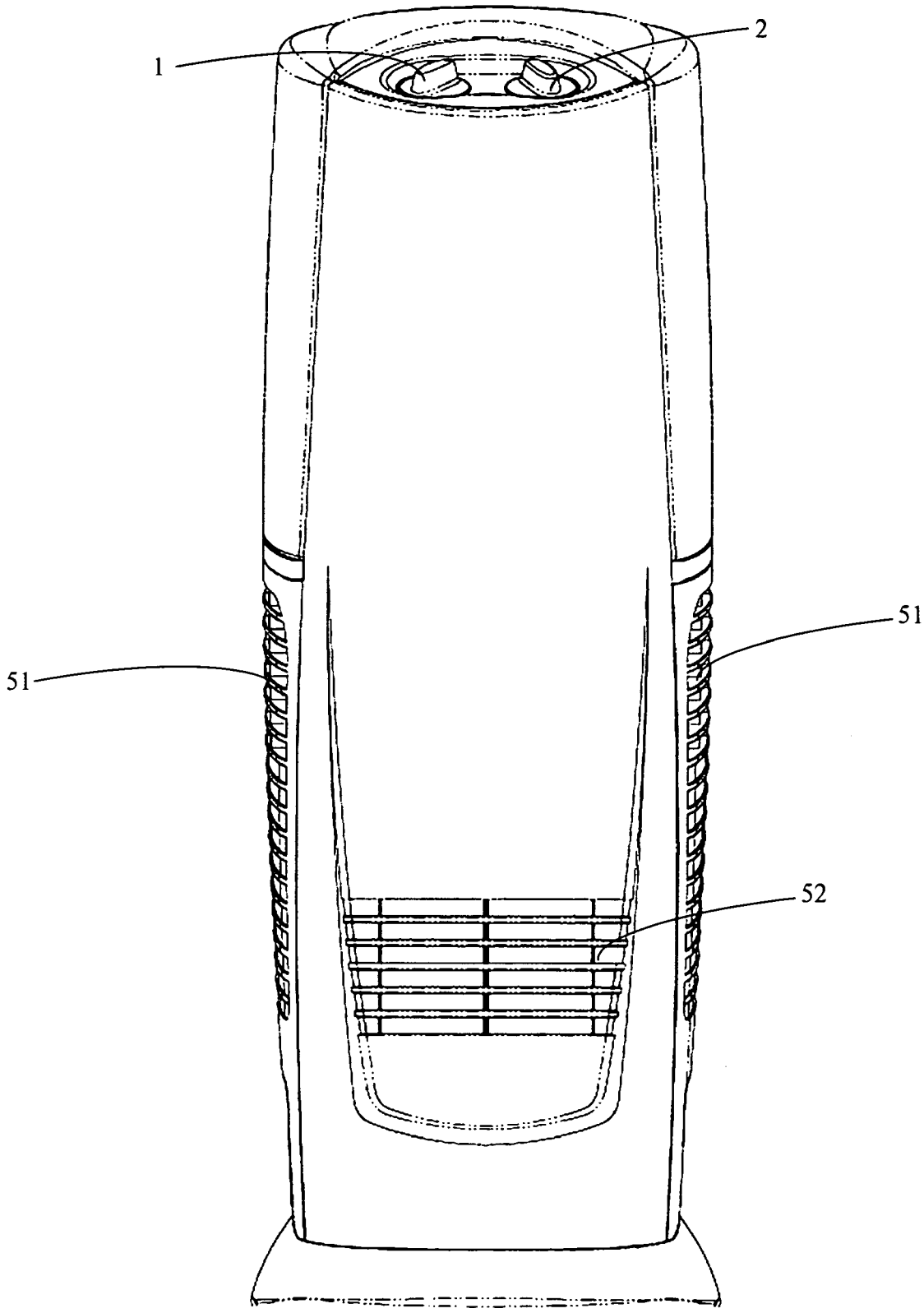
FIG. 2 is a front elevational view of the humidifier of FIG. 1.

Referring first to FIGS. 1 and 2, an air humidifier 100 in accordance with the present invention preferably takes the shape of an elongated tower. Two operating switches are preferably included—controller 1 for controlling the speed of the fan and controller 2 for controlling the humidity of ambient air, as described in further detail below.

Figure 3:
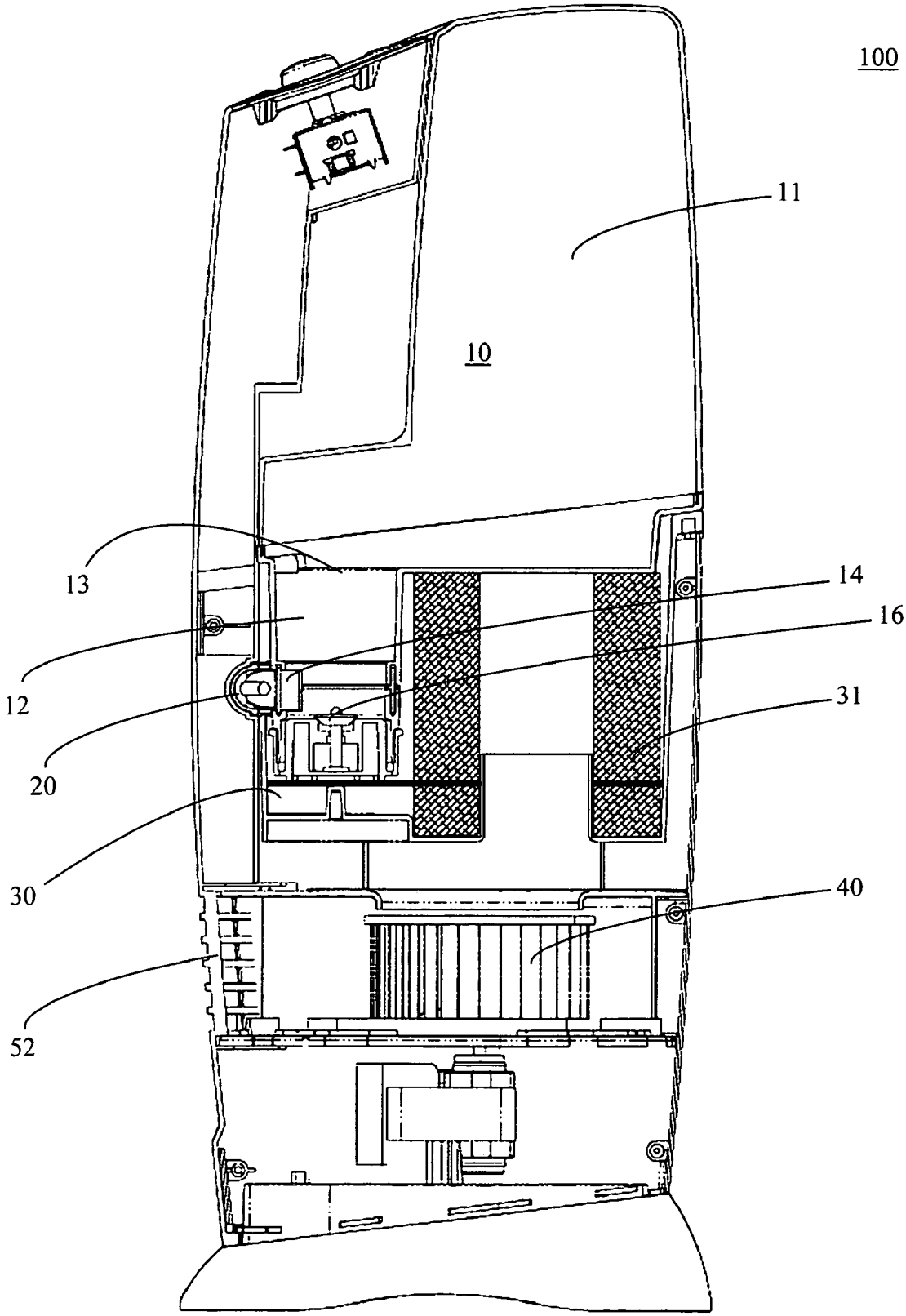
FIG. 3 is a cross-sectional view taken along line A-A' in FIG. 1.
Figure 4:
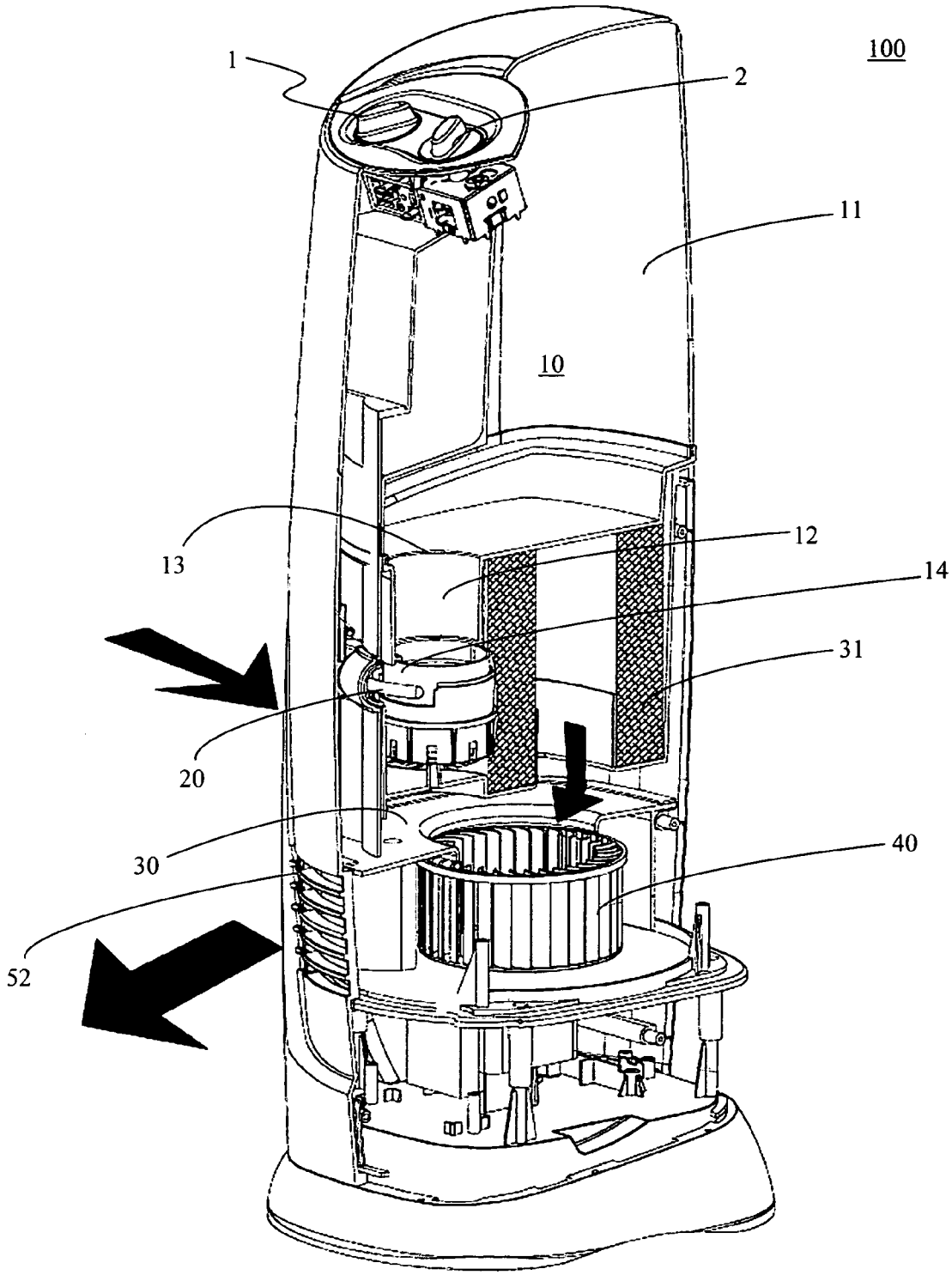
FIG. 4 is a perspective view of the interior of the humidifier of FIG. 1.

Turning now to the FIGS. 3 and 4, a humidifier 100 in accordance with the present invention includes a water reservoir 10 having two separate compartments: a first and larger compartment 11 used to store most of the water used in the humidifier 100; and a second and smaller compartment 12 used for holding a portion of the water for UV irradiation before that water portion is released further downstream to be used for adding moisture to an air flow. Preferably, the two reservoir compartments 11 and 12 are connected via an opening 13 sufficiently large to allow exchange of water back and forth between the compartments 11 and 12. In addition, the bottom of the larger compartment 11 is preferably biased toward the opening 13 such that water in the larger compartment naturally flows toward and into the smaller compartment 12 due to gravity. The water reservoir 10 is preferably removable for refill and cleaning purposes.

The source of UV irradiation is preferably a replaceable germicidal UV lamp 20, which is well-known in the art. The second or smaller reservoir compartment 12 preferably includes a window 14 on its wall permeable to UV light, preferably a glass window and more preferably a crystal glass window, such that the UV lamp 20 may be placed outside of the second reservoir compartment 12 adjacent to the window 14 to irradiate UV light through the window 14 and on the water inside the second reservoir compartment 12. Alternatively, the UV lamp 20 may be placed inside the second compartment 12.

Preferably, the second reservoir compartment 12 further includes an orifice 15 (not shown) at the bottom, connecting to a water valve 16 below the compartment to allow UV-irradiated water to exit the water reservoir 10. A water tray 30 is used to collect the water exiting the second reservoir compartment 12 and via the water valve 16. At least one filter 31 capable of soaking up water, such as a wick filter, is placed partially inside the water tray 30 such that one end of the filter 31 is submerged in the water collected in the water tray 30. The filter 31 is preferably removable and replaceable.

The air humidifier 100 further includes a fan or air blower 40, preferably a motorized rotary fan placed downstream of the water tray 30 and filter 31. In addition, the humidifier 100 includes grille members 51 and 52, allowing dry air to enter the humidifier 100 and moistened air to flow out of the humidifier 100, respectively.

In operation, water is poured into the first reservoir compartment 11 and flows into the second compartment 12 via the opening 13. As the water in the second compartment 12 is being irradiated with UV light from the UV lamp 20, the irradiated water exchanges with the water in the first compartment 11 via the opening 13, as the mineral/impurity content of the water around the opening 13 attempts to reach equilibrium due to the mineral/impurity concentration differences between the water in the first compartment 11 and that in the second compartment 12. As such, a mineral/impurity concentration gradient is created in the water at the opening 13. While the water is sanitized inside the second reservoir compartment 12, the sanitized water gradually diffuses into the water in the first compartment 11.

The water in the second compartment 12 slowly flows out of the compartment 12 via the orifice 15 (not shown) and water valve 16, and into the water tray 30 below. As the water collecting in the water tray 30 reaches above a certain level (e.g., near the bottom portion of the water valve 16), pressure equilibrium is reached between the water inside the second compartment 12 and the in water tray 30 below, and the water stops flowing out of the second reservoir compartment 12. Alternatively, an adjustable valve (not shown) and a sensor (not shown) may be used to control the water flow by opening and shutting off the value as the water collecting in the tray 30 reaches a certain level.

The filter or filters 31 placed partially in the water tray 30 soak up the water collected in the tray 30. As the rotary fan 40 turns, it sucks dry, ambient air through the air inlet grille 51 into the humidifier 100, through the water-soaked filter 31, and blows moistened air out via the outlet grille 52. The general movement of air flow into and out of the humidifier 100 is shown by the arrows in FIG. 4. As the air flow passes through the filter 31, the larger contaminants in the air are trapped inside the filter 31 and the cleaner air is humidified with the water soaked in the filter 31.

Referring back to FIG. 1, the fan speed controller 1 preferably has multiple settings to control the speed of the rotary fan 40, thereby controlling the air flow. Controller 2 controls the humidity of the ambient air and is preferably a humidistat. A particular humidity level may be set using controller 2 such that when the inlet air reaches the desired humidity, the humidifier 100 shuts off. Similarly, if the ambient humidity drops below the set point, the humidifier 100 is automatically turned on.

Although the invention herein has been described with reference to a particular embodiment, it is to be understood that the embodiment is merely illustrative of the principles and application of the present invention. It is therefore to be understood that various modifications may be made to the above mentioned embodiment and that other arrangements may be devised without departing from the spirit and scope of the present invention as defined by the appended claims.

What is claims is:

1. An apparatus for adding humidity to an air flow composing:

a water reservoir having a first compartment and a second compartment, the first compartment adjoining the second compartment at common opening; and an ultraviolet light source, wherein the opening is large enough to allow sufficient exchange of water flowing back and forth between the first and second compartments, and wherein the ultraviolet light source irradiates ultraviolet light on the water inside the second compartment.

2. The apparatus of claim 1, wherein the ultraviolet light source is an ultraviolet lamp.

3. The apparatus of claim 2, wherein the ultraviolet light source is inside the second compartment.

4. The apparatus of claim 2, wherein the second compartment comprises an ultraviolet-light-permeable window to allow the ultraviolet light source to irradiate on the water in the second compartment from outside of the second compartment.

5. The apparatus of claim 4, wherein the second compartment further comprises an exit orifice through which the water exits out of the second compartment.

6. The apparatus of claim 5, wherein the water flowing out of the second compartment via the exit orifice is at least 20% mineral/microorganism/contaminant free.

7. The apparatus of claim 6, wherein the water flowing out of the second compartment via the exit orifice is at least 50% mineral/microorganism/contaminant free.

8. The apparatus of claim 7, wherein the water flowing out of the second compartment via the exit orifice is at least 80% mineral/microorganism/contaminant free.

9. The apparatus of claim 8, wherein the water flowing out of the second compartment via the exit orifice is at least 90% mineral/microorganism/contaminant free.

10. The apparatus of claim 6, further comprising an adjustable valve connected to the exit orifice, wherein the valve controls the amount of water flowing via the exit orifice.

11. The apparatus of claim 10, further comprising a water tray for receiving the water exiting from the second compartment.

12. The apparatus of claim 11, further comprising a mechanism for shutting off the valve when the water collecting in the water tray reaches a first level, and opening the valve when the water collecting in the water tray drops below a second level.

13. The apparatus of claim 12, wherein the mechanism is a sensor connected to the valve.

14. The apparatus of claim 13, further comprising:

at least one wick filter capable of soaking up water; and a rotary fan, wherein the at least one wick filter is placed in the water tray and, as the rotary fan turns, air passes through the at least one wick filter and becomes humidified by the water in the at least one wick filter.

15. A method of humidifying an air flow, comprising the steps of:

storing water in a reservoir having a first compartment and a second compartment with an orifice, the two compartments being adjoined at common opening sufficiently large to allow flow of water back and forth between the first and second compartments;

irradiate ultraviolet light on the water in the second compartment for a sufficient amount of time to reduce the mineral content of the water, wherein the water flows out of the second compartment via the orifice.

16. The method of claim 15, further comprising collecting the water inside a water tray after the water exits the second compartment via the orifice.

17. The method of claim 16, further comprising the step of using a mechanism to control the outflow of water from the second compartment.

18. The method of claim 17, wherein the mechanism comprises a valve connected to the orifice and a sensor for opening and closing the valve when the water in the water tray drops below or above a certain level, respectively.

19. The method of claim 18, further comprising the steps of:

soaking up the water in the water tray with at least one wick filter; and forcing the air flow through the at least one wick filter.

20. The method of claim 19, wherein the air flow is forced through the at least one wick filter by using a rotary fan downstream of the at least one wick filter.

* * * * *